US008120616B2

(12) United States Patent
Desjardins et al.

(10) Patent No.: US 8,120,616 B2
(45) Date of Patent: Feb. 21, 2012

(54) COLOR SAMPLER

(75) Inventors: Nicolas Desjardins, Pointe-Claire (CA); Kuo-Cheng Tong, Toronto (CA)

(73) Assignee: Autodesk, Inc., San Rafael, CA (US)

( * ) Notice: Subject to any disclaimer, the term of this patent is extended or adjusted under 35 U.S.C. 154(b) by 1030 days.

(21) Appl. No.: 12/072,523

(22) Filed: Feb. 27, 2008

(65) Prior Publication Data

US 2009/0213136 A1 Aug. 27, 2009

(51) Int. Cl.
*G09G 5/02* (2006.01)

(52) U.S. Cl. ..... 345/593; 345/589; 345/594; 345/606; 345/611; 382/260; 715/964

(58) Field of Classification Search ..... None
See application file for complete search history.

(56) References Cited

U.S. PATENT DOCUMENTS 5,254,978 A * 10/1993 Beretta ..... 345/601
5,615,320 A * 3/1997 Lavendel ..... 345/594
7,768,525 B2 * 8/2010 Hsu ..... 345/593

* cited by examiner

*Primary Examiner* — Antonio Caschera
(74) *Attorney, Agent, or Firm* — Patterson & Sheridan, LLP

(57) ABSTRACT

A method for selecting a desired color from a screen display using a color selection tool that may appear as an eyedropper. Rather than independently choosing pixels or a matrix of pixels, the user blends a color by selecting pixels using a mouse cursor. In response, the color of each selected pixel is incrementally blended into the current color at a constant rate. That is, each selected pixel is blended with the current color according to a constant blending factor. In this manner, the current color changes at a constant rate with the contribution of each successive pixel. This approach allows the user to gradually blend colors from the screen display, much as a painter would gradually mix colors on a palette.

15 Claims, 4 Drawing Sheets
(2 of 4 Drawing Sheet(s) Filed in Color)

COLOR SAMPLER

BACKGROUND OF THE INVENTION

1. Field of the Invention

The present invention generally relates to computer software. More specifically, the present invention relates to a computer aided design (CAD) application configured for choosing a color to be used by the designer.

2. Description of the Related Art

The term computer aided design refers to a broad variety of computer-based tools used by architects, engineers, animators, video game designers, and other graphics and design professionals. CAD applications may be used to construct computer models or drawings representing virtually any imaginable construct. Commonly, CAD applications utilize colors to compose a visually-pleasing scene or image. A CAD application generally includes a color palette or color wheel from which a user of the CAD application may choose a color to work with. Colors can then be applied to almost any object within the computer model or drawing. Graphical design programs and photo/video editing software tools provide similar features.

A common feature of CAD applications is the ability to "pick" a color from a pixel that appears on the screen. Most commonly, the tool used for this feature is an "eyedropper" and is often referred to as the "color picker." Generally, a user chooses a color selection tool from a list of available tools. The user then uses a human interface device, e.g., a mouse, to move the eyedropper to a pixel on the screen that represents the color the user would like to choose. Selecting a pixel, e.g., by left-clicking with the mouse, selects the pixel immediately below the eyedropper and sets the color value associated with that pixel as a currently selected color. The currently selected color may then appear in a color dialog box. The user of the CAD application may then apply the selected color to objects in the CAD drawing.

Additionally, the color picking feature may provide a color preview window. For example, the user may choose the color picker tool and move the mouse to an area of the screen where a desired shade of green appears. A color preview window may display to the user what color would be selected at each pixel as the user moves the mouse around the screen. The color preview window may be useful for a user who wishes to select a specific shade of a color from a region of the screen that has a variety of shades of that color. For example, in a CAD drawing depicting a forest, a user may wish to select a specific shade of green.

However, choosing a desired color has proven to be challenging. Prior art techniques for color picking generally only allow a user to select the color associated with one pixel on the screen. Other prior art techniques allow for the selection of a 3×3 or 5×5 pixel matrix, where the selected color is an average color of all the pixels in the pixel matrix. Both of these prior art techniques rely on "point sampling," where each selection is independent of other selections. These prior art approaches often result in a user having to select, by trial and error, multiple colors from the screen until the desired color is achieved.

Furthermore, it is sometimes impossible to pick the desired color because the color simply does not exist in the image on the screen. Many differently colored pixels, when viewed as a whole, may appear as one color, but when a user is trying to select a color that represents the general impression of a region, no pixel in the region may actually provide the desired color.

While these techniques work as intended, they have a significant limitation in that the color selection tool only allows users to perform a point-sampling, where the selection is based on a single pixel or a small grid of pixels. That is, each action of selecting a color using the tool is independent of one another. Frequently, users do not pick their desired color, but something "close." In such a case, the user can either pick another pixel using the color sampling tool or adjust the RGBA values in an attempt to create the desired color.

Accordingly, there remains the need in the art for a technique for selecting a desired color using a color selection tool.

SUMMARY OF THE INVENTION

One embodiment of the invention provides a method for selecting a desired color from a screen display using a color selection tool. The method may generally include receiving a selection of a screen pixel on the screen display, determining a first color value corresponding to the color of the screen pixel, and determining a second color value corresponding to an active color setting. The method may also include blending the first color value with the second color value to generate a third color value, where the first color value and the second color value are blended based on a constant blending factor. Once blended, the third color value may be stored as the active color setting. In a particular embodiment, the color values of multiple on-screen pixels may be successively blended into the active color value. Thus, the method may further include receiving a selection of one or more additional color values, where each color value corresponds to a color of a screen pixel on the screen display and include successively blending each of the one or more additional color values with a color value of the active color setting, where each of the one or more additional color values is successively blended with the color value of the active color setting based on the constant blending factor.

Embodiments of the invention provide a more sophisticated color sampling tool. In particular, a color sampling tool where a user may blend colors into a current color by selecting one or more pixels on a screen display. Rather than independently choosing pixels or a matrix of pixels, the user blends a color by selecting pixels using a mouse cursor. In response, the color of each selected pixel is incrementally blended into the current color at a constant rate. Specifically, each selected pixel is blended with the current color according to a constant blending factor. In this manner, the current color changes at a consistent rate with the contribution of each successive pixel. This approach allows the user to gradually blend colors from the screen display, much as a painter would gradually mix colors on a palette. For example, when the current color is yellow, a user may "scrub" a reddish region of the screen by rapidly moving the eyedropper cursor back and forth across the reddish region. In response, the current color would slowly fade to orange, and eventually to red.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF THE PREFERRED EMBODIMENTS

Embodiments of the invention provide a CAD application configured to select a desired color from a screen display using a color selection tool. Generally, a CAD application may be configured with many tools that the user may utilize in composing a design. One such tool may be a color selection tool. When the tool is activated, the appearance of a mouse cursor changes to resemble an eyedropper. The user may then use the eyedropper to select a desired color. However, rather than simply replacing the current color with a new one, a selected color is blended into a current one. By configuring the CAD application to behave in this manner, a user may blend colors together more intuitively; similar to the way an artist blends different colors of paint together on a palette.

Figure 1:
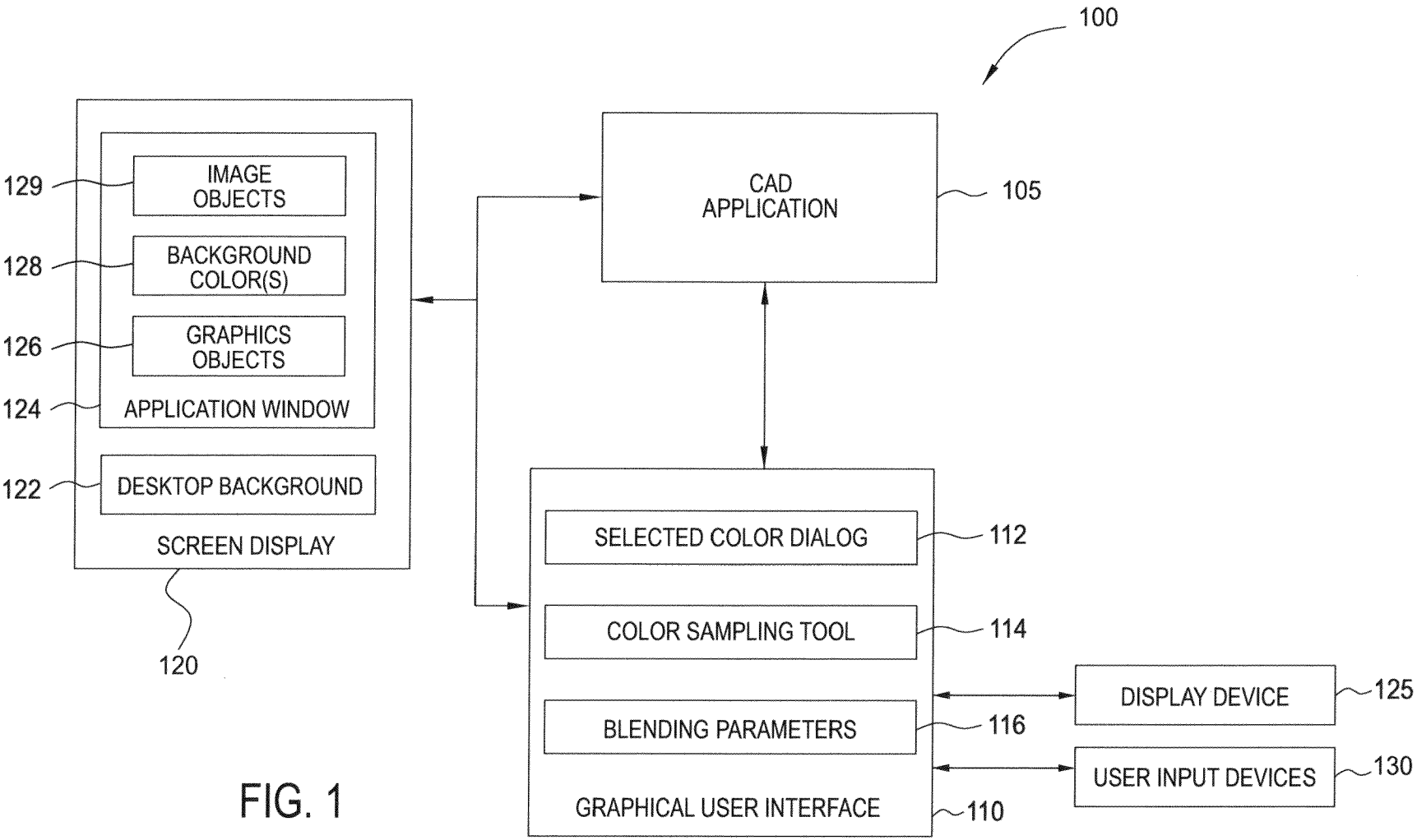
FIG. 1 is block diagram illustrating components of a CAD application used in selecting a color from a screen display, according to one embodiment of the invention.

FIG. 1 is block diagram illustrating components of a CAD application used in selecting a desired color from a screen display using a color selection tool, according to one embodiment of the invention. The components illustrated in system 100 may include computer software applications executing on existing computer systems, e.g., desktop computers, server computers, laptop computers, tablet computers, video game consoles, and the like. The software applications described herein, however, are not limited to any particular computing system and may be adapted to take advantage of new computing systems as they become available.

Additionally, the components illustrated in system 100 may be implemented as software applications that execute on a single computer system or on distributed systems communicating over computer networks such as local area networks or large, wide area networks, such as the Internet. For example, a graphical user interface 110 may include a software program executing on a client computer system at one physical location communicating with CAD application 105 at another physical location. Also, in one embodiment, CAD application 105 and graphical user interface 110 may be provided as an application program (or programs) stored on computer readable media such as a CD-ROM, DVD-ROM, flash memory module, or other tangible storage media.

As shown, the system 100 includes, without limitation, CAD application 105, graphical user interface 110, screen display 120, user input devices 130, and a display device 125. Those skilled in the art will recognize, however, that the components shown in FIG. 1 are simplified to highlight aspects of the present invention and that a typical CAD application 105 and GUI interface 110 may include a broad variety of additional tools and features used to compose and manage a design or drawing. CAD application 105 may be configured to allow users interacting with GUI interface 110 to compose CAD designs or drawings. Accordingly, CAD application 105 and GUI interface 110 may include programmed routines or instructions allowing users to create, edit, load, and save CAD designs or drawings. User input devices 130 may include a mouse pointing device, a keyboard, a joystick or a video game controller and display device 125 may be a CRT or LCD display.

Illustratively, the screen display 120 may include an application window 124 and a desktop background 122. CAD application 105 may be executing on a Microsoft Windows® platform, such that the CAD application 105 is viewable in an application window 124. If the application window is maximized, the desktop background 122 is not visible behind the application window 124. However, if the application window 124 is not maximized, some or all of the desktop background 122 may be visible. The application window 124 is a typical program window that a user sees when using a computer program. The application window 124 may include graphics objects 126, background colors 128, or image objects 129. The CAD application 105 may be a drawing application that allows for the selection of a background color 128 for a design or drawing. In such a case, the background color 128 may be visible on the screen display 120 or it may be hidden. Further, image objects 129 may be loaded into the CAD application 105 for use in a CAD drawing. Image objects may be represented using the known JPG, GIF, BMP, or TIFF formats, or any other type of image format. Furthermore, the user of a CAD application 105 may define graphics objects 126 that appear as two-dimensional (2D) or as three-dimensional (3D) objects. Graphics objects 126 may be 3D objects representing real-world constructs being modeled, 3D animation characters to be rendered, or 2D vector graphics. Image objects 129, background colors 128, and graphics objects 126 may all be visible in an application window 124 of the CAD application 105.

Graphical user interface 110 provides tools used to manipulate CAD designs and drawings. As shown, graphical user interface 110 includes blended color sampling tools 114, a selected color dialog 112, and blending parameters 116. Those skilled in the art will recognize, however, that the tools of GUI interface 110 shown in FIG. 1 are simplified to highlight aspects of the present invention and that a typical CAD application 105 and GUI interface 110 may include a broad variety of additional tools and features used to compose and manipulate CAD designs and drawings.

In one embodiment, color sampling tool 114 may provide GUI elements that allow a user to select color based on colors then currently present on screen display 120. Color sampling tools 114, when activated, may change the appearance of a mouse cursor to resemble an eyedropper. The user may use the eyedropper to select a screen pixel. In response, the application 105 may determine a set of color values of the selected pixel (e.g. an RGBA value). A selected color dialog 112 may provide a preview of the selected color. The color shown in the selected color dialog 112 may be defined using a color of a pixel directly underneath the point of the eye-dropper cursor. The selected color dialog 112 may display the selected color after a user has clicked on a screen pixel using the mouse. Alternatively, the selected color dialog may preview the color to be chosen as the user moves the mouse around the screen display 120, without clicking on a particular pixel.

Additionally, color sampling tools 114 may also be configured to allow the user to mix or blend colors with a selected color. When used to blend colors, color sampling tool 114 may change the appearance of a mouse cursor to resemble that of a filled eyedropper. In one embodiment, blending parameters 116 may be set using a GUI interface that allows a user to specify a ratio for blending colors. The blending ratio, as defined by blending parameters 116, defines the rate at which newly selected colors are blended with the current color. For example, a larger blending ratio blends a color by selecting a larger percentage of a newly selected color with a then current color. Alternatively, application 105 may be configured with a fixed blending ratio.

Figure 2:
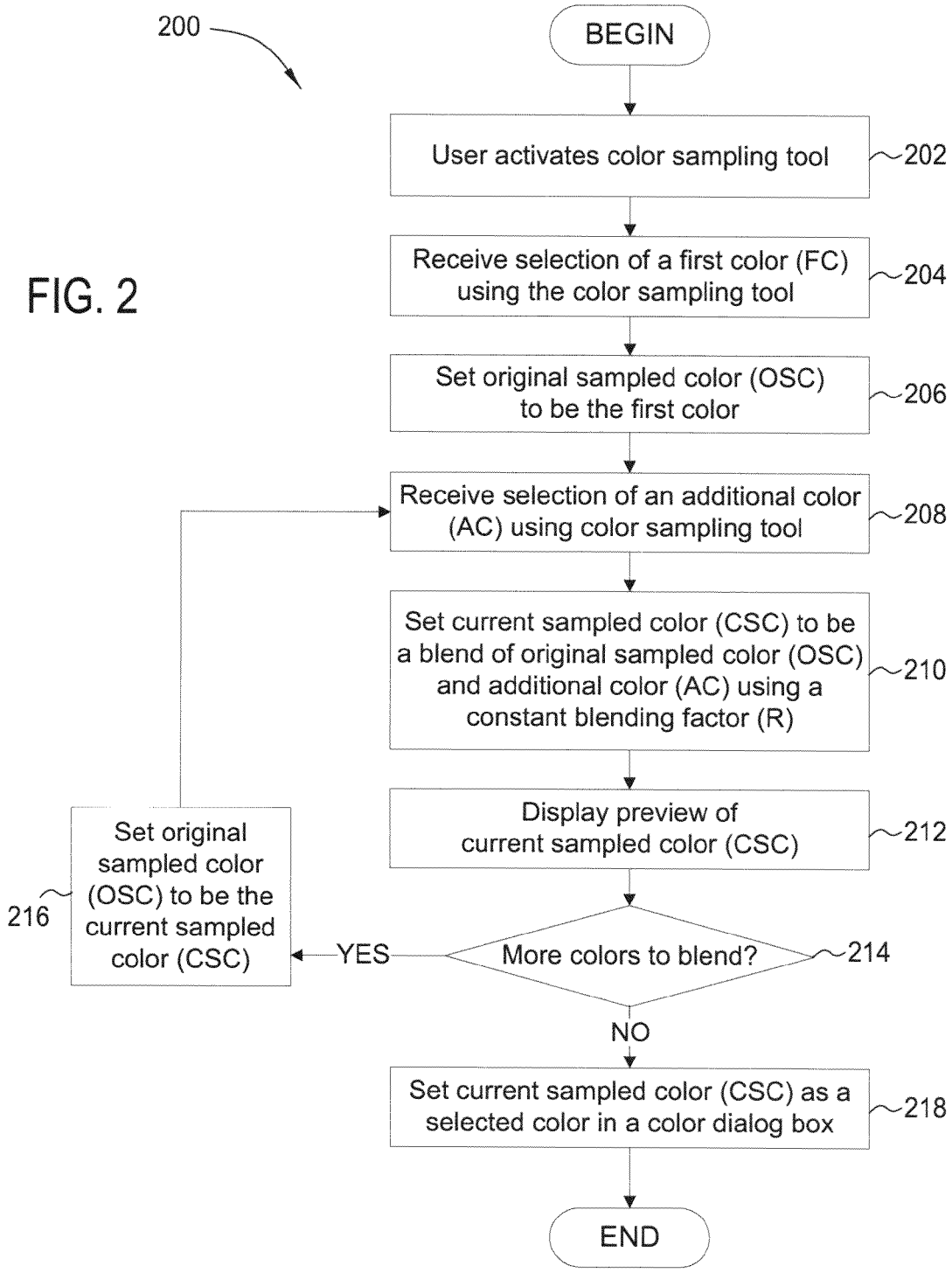
FIG. 2 is a flow chart illustrating a method for blending a color from a screen display, according to one embodiment of the invention.

FIG. 2 is a flow chart illustrating a method 200 for blending a color from a screen display, according to one embodiment of the invention. Persons skilled in the art will understand that even though the method is described in conjunction with the system of FIG. 1, any system configured to perform the steps of the method illustrated in FIG. 2, in any order, is within the scope of the present invention. Further, persons skilled in the art will understand that the steps of the method described in FIG. 2 are only one embodiment of the present invention.

As shown, method 200 begins at step 202, where a user of the CAD application activates the color sampling tool used to create a blended color. In response, the CAD application may change a mouse cursor to appear as an eyedropper. At step 204, the CAD application receives a first color selected using the blended color sampling tool. The first color may correspond to the color of a pixel underneath the mouse cursor clicked on by a user interacting with a mouse.

At step 206, the CAD application sets an original sampled color (OSC) to be the first color (FC). The OSC serves as a starting color with which a user may blend other colors to achieve the desired color. At step 208, the CAD application receives a selection of an additional color (AC). This selection may be received in response to a user clicking on a pixel on the screen with the eyedropper cursor.

Alternatively, a current color may be used as the first color. In one embodiment, the user may set the application in blend mode by holding down a key, such as the <shift> key or <control> key. In such a case, whatever the current color is the user hits the key is used as the first color. For example, assume a current color of blue when the user turns-on blended color picking, (e.g., by activating the color picking tool and holding down the <shift> key). If the user then clicks on a yellow region of the screen with the cursor, the application may set the current color to a greenish blue (i.e., a little yellow is blended into the blue).

At step 210, the CAD application sets the current sampled color (CSC) to be a blend of the original sampled color (OSC) and the additional color (AC) using a constant blending factor (R). In one embodiment, the blending may be determined using a blending equation such as the following:

$$CSC = (AC)\left(\frac{1}{R}\right) + (OSC)\left(\frac{R-1}{R}\right)$$

Additionally, the CAD application may display the blended CSC at step 212. Note, importantly, the CSC is not simply the result of averaging over all the sampled color values. Such an approach would wash-out the ability to blend in colors over time. For example, selecting two pixels would result in a 50/50 split between the OSC and the AC. But, if more colors were to be blended, as in steps 214-216, after one hundred pixels were blended, each newly sampled color would contribute only 1% to the overall averaged color. Each additional pixel selected after the one-hundredth pixel would contribute even less to the final color, thus reducing and eliminating, any useful functionality. To address this problem, embodiments of the invention blend each newly selected color into the current color using a constant blending factor (R). In one embodiment, the blending factor (R) is 150. Thus, each additional pixel contributes 1/150 of the total color value and the OSC contributes 149/150 of the total color value. In another embodiment, the constant blending factor can be any number in the range of about 100 to about 200. Such a blending factor allows users to blend in new colors quickly, while also providing users with a suitable level of fine-grained control over the blending process.

As described, a user may wish to blend multiple pixels or colors to achieve the desired color. As steps 214-216, if more colors are to be blended, the CAD application sets the OSC to be the CSC and proceeds back to step 208. The CAD application may traverse steps 208-216 as many times as required until the user achieves the desired color. When processing steps 208-216, the CAD application may receive selections of additional colors in a variety of ways. In one embodiment, each additional color selected at step 208 may be the result of a user clicking on a particular pixel in the screen display. As each additional pixel's color values are blended, the CAD application may display a preview of each current sampled color at step 212.

In another embodiment, each additional color selection at step 208 may be the result of a user clicking on a pixel, and then while holding down the mouse button, dragging the mouse across the screen. If a user "clicks-and-holds-and-drags" the mouse and the mouse moves two inches on the screen, the cursor traverses a large amount of pixels. If each pixel along the path were blended using the method of the invention, the color may change too rapidly to be useful. Thus, the pixels traversed using the click-and-hold method may be sampled based on mouse events managed by an operating system. Typically, the mouse pointing device is configured to send interrupts to the operating system when the user moves or clicks the mouse. In response, the operating system sends data about the mouse position and button state to the active application as messages or events. Alternatively, an application may sample the operating system to learn the current mouse state at any given moment. These events are queued in a buffer and an application's message processing loop handles them one after the other. The message queue may also contain keyboard events or messages to repaint the application, etc.

In one embodiment, the CAD application may receive a selection of a new color each time the mouse is polled by the operating system (or each time the mouse triggers an interrupt). Thus, not every pixel along a path traversed by the cursor is blended into the current color, and instead the mouse position may be periodically sampled by the application. The sampled positions may be queued as a result of interrupts generated by the mouse or polling performed to learn the then current mouse position. Thus, only those pixels where the cursor is located when the mouse is polled are blended into the current color. In another embodiment, only those pixels sampled from a different location on the screen display than the previously sampled pixel are blended into the current color. This approach leads to a more intuitive solution because if a user clicks-and-holds the mouse, but does not move it, then no new pixels will be added to the blended color because at each poll of the mouse the location of the selected pixel is the same. Also, if the user clicks, holds, and then moves the mouse slowly, the operating system does not detect a mouse movement and thus less pixels are sampled and blended. This leads to an intuitive result because the blended color changes more slowly. Similarly, if the eyedropper cursor is "scrubbed" across a region of the screen the blended color changes more quickly. As used herein, "scrubbing" refers to a process where the user clicks-and-holds-and-drags the mouse in a back-and-forth motion across a region of the screen. If the user scrubs the mouse quickly, the CAD application will receive more samples of additional color because less operating system polls are deemed "no motion" or alternatively, fewer interrupts are generated. Again, this is an intuitive result because scrubbing more quickly would mix more additional pixels into the current color.

Once the user has achieved the desired color using any of the approaches described above, at step 218, the CAD application sets the current sampled color as a selected color and may display that color in a color dialog box. Alternatively, the selected color may be displayed in some portion of the maintenance window, or not displayed at all. In any of these cases, the end result is that the final color is set as the active color in whatever operating context the user is currently in. The user of the CAD application may then use the selected color as necessary in the CAD drawing or design.

Figure 3A:
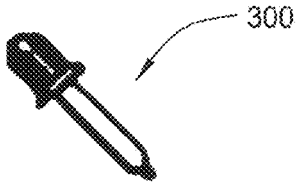
FIG. 3A illustrates a color selection tool, according to one embodiment of the invention.
Figure 3B:
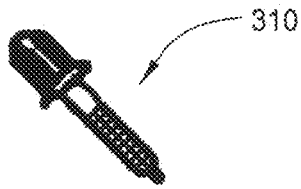
FIG. 3B illustrates a color selection tool, according to one embodiment of the invention.

FIGS. 3A-3B illustrate color selection tools, according to one embodiment of the invention. As described above, the color selection tool may change the appearance of a mouse cursor to that of an eyedropper. Illustratively, FIG. 3A shows an eyedropper cursor 300 displayed to the user when the user desires to pick an individual color using a known point sampling technique, without blending. In contrast, FIG. 3B shows a filled eyedropper cursor 310 which may be displayed when the user selects to use the blended color sampling tool described above. In yet another embodiment, the user may toggle between eyedroppers 300, 310 of FIG. 3A and FIG. 3B by holding down the SHIFT key on the keyboard. Of course, the eyedropper cursors shown in FIG. 3A and FIG. 3B is an example of how the interface may represent the current color select mode to the user and other cursor images or interface may be used to represent this information to the user.

Figure 4:
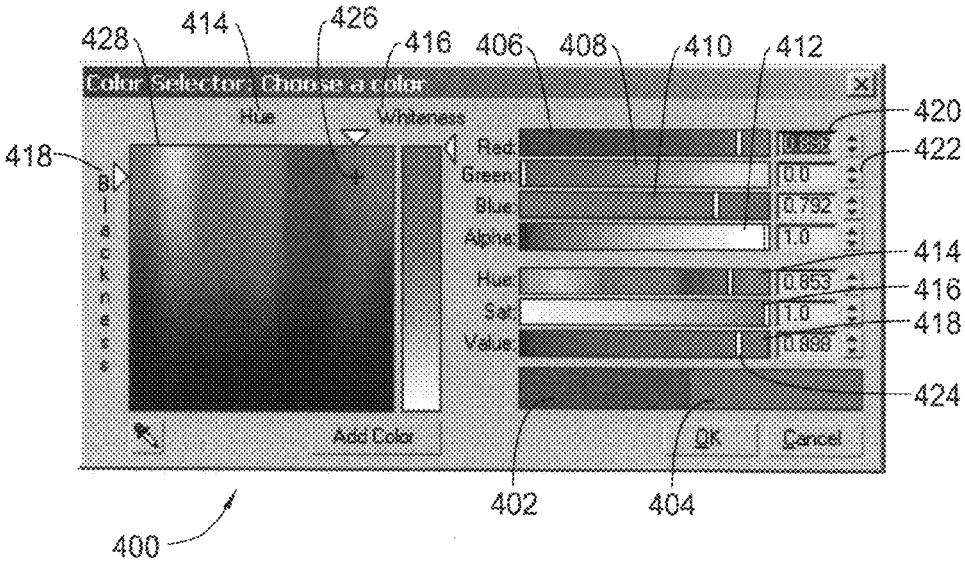
FIG. 4 is a screen shot of a color selection dialog and preview window, according to one embodiment of the invention.

FIG. 4 is a screen shot of a color selection dialog 400 and preview window, according to one embodiment of the invention. The color selection dialog 400 may be a GUI interface in the CAD application that allows the user to manually adjust the color values associated with a selected color. For example, as is known, users may manually adjust an RGBA color by adjusting a red value 406, a green value 408, a blue value 410, or an alpha value 412 of a selected color. A similar GUI may be displayed for a CMYK color. Furthermore, the user may adjust the hue 412, saturation 416, or value 418 of a selected color. Illustratively, dialog 400 allows the user to perform these adjustments in four ways. First, a user may manually input the desired numerical value for each color parameter using a text input field 420. Second, the user may increment the numerical value using up/down arrows 422. Third, the user may use a slider 424 to adjust each parameter. Fourth, the user may select the desired color using a target 426 in a color chooser 428.

In one embodiment, the original selected color (OSC) 402 may be displayed in the color selection dialog 400. As shown in FIG. 4 for example, the OSC 402 is generally a blue shade. After the user has adjusted one or more of the color parameters 406-418 of the OSC 402, a preview 404 of the new color may be displayed in the color selection dialog 400. In FIG. 4, the preview 404 displays the newly adjusted color as a magenta shade. In one embodiment, as a user blends colors using the color sampling tool, preview 404 may display a preview of the resulting blended color as each new color sample is blended in the current color. Thus, the preview 404 may provide live feedback as to what color would be selected using the current blend. Once the user has created the desired color, dialog 400 may allow the user to confirm the selection of a new color. In such a case, the color then shown in preview 404 may be used to set the active color of the CAD application used in subsequent drawing or design operations (e.g., a fill operation used to shade an enclosed region of a CAD drawing).

Additionally, in one embodiment, the blending parameters 116 of FIG. 1 may be adjusted in the color dialog 400 of FIG. 4 (not shown in FIG. 4). In such an embodiment, the user may be able to set the blending factor (R) with which each additional color is blended with the original sampled color. For example, continuing with the example above, if the blending factor for each additional pixel were reduced from 150 to 75, then each additional pixel would contribute a larger amount to the color values associated with the current color, and the color would change more quickly as the user blends colors selected from a screen display.

Figure 5:
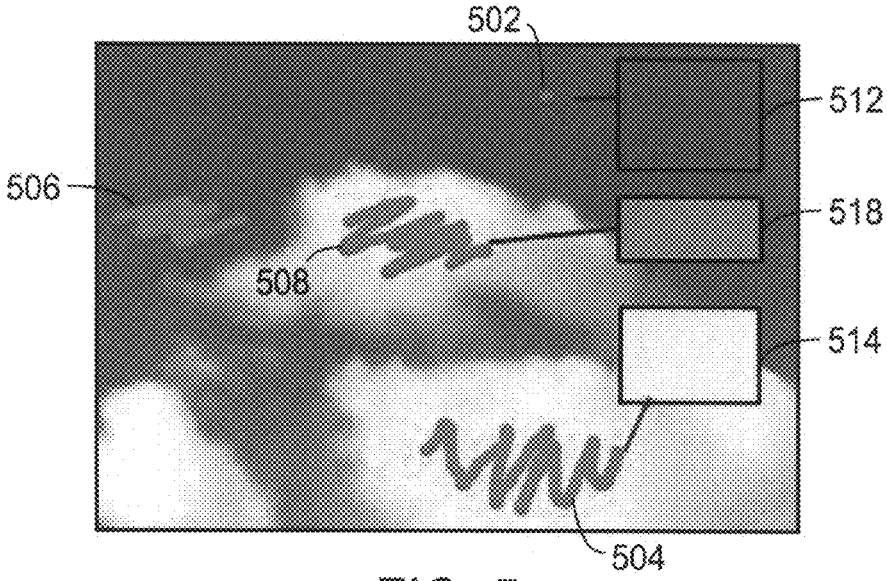
FIG. 5 illustrates three examples of color selections being made using a color sampling tool, according to one embodiment of the invention.

FIG. 5 illustrates three examples of color selections being made using a blended color sampling tool, according to one embodiment of the invention. In these examples, FIG. 5 illustrates a blue sky with clouds. The color of the sky near the top of FIG. 5 is a fairly uniform blue shade. If a user selects pixel 502, a sampled color 512 may be set to a blue color associated with the color value of pixel 502.

In another example shown in FIG. 5, the user wants to select a color of one of the clouds, a generally white shade. Because the clouds are not uniform in color, the user may click-and-hold the mouse while dragging it over path 504. A sampled color 514 shows the color that results from blending the color samples blended from pixels along path 504.

In yet another example, the user desires to select a light blue color from the image of FIG. 5. First, the user may click-and-hold the mouse while dragging it over path 506. Because the region covered by path 506 is generally a blue shade, this results in a blue color being selected. The user then decides that the blue shade selected is "too blue" and decides to lighten it by blending in more white. Accordingly, the user may drag the eyedropper cursor over path 508. This scrubbing of the white pixels results in sampled color 518. As shown, sampled color 518 is a lighter shade of blue than selected color 512, which was taken from the sampled pixel 502. This example illustrates how embodiments of the invention may be used to blend colors into a current color in a manner similar to the way an artist blends different colors of paint together on a palette.

Figure 6:
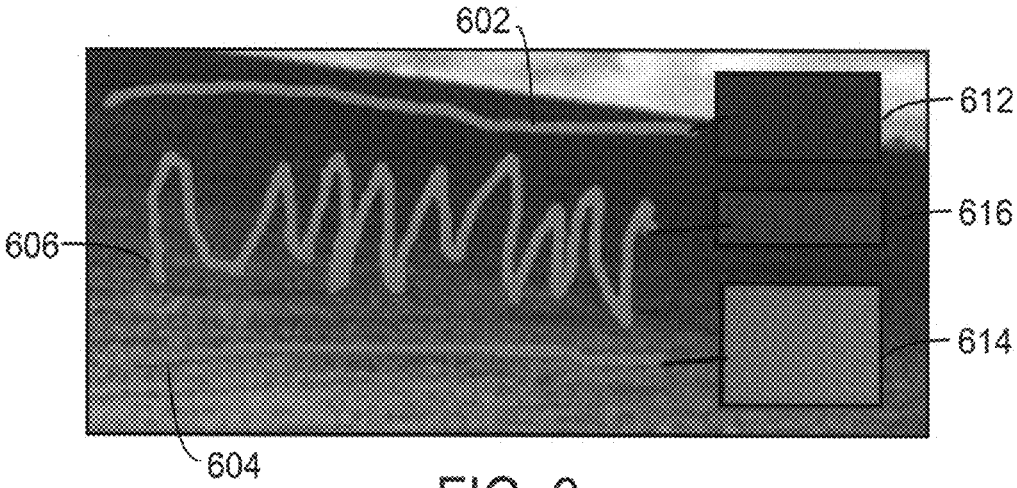
FIG. 6 illustrates three examples of color selections being made using a blended color sampling tool, according to one embodiment of the invention.

FIG. 6 illustrates three examples of color selections being made using a blended color sampling tool, according to one embodiment of the invention. The first example shows the user selecting a dark green color from the top of a display of a grassy hill. Note, the coarse texture of the grass results from a mixture of lighter green pixels mixed in with darker green pixels. Instead of hunting for the desired dark green color by trial-and-error using point sampling, the user simply clicks and drags the eyedropper cursor over a dark area along path 602. Because there are more dark green pixels than light green pixels along path 602, a sampled color 612 is more dark than light. Sampled color 612 is close to a color the user would see if the user squinted their eyes at the display of dark-colored grass (which includes contributions from the lighter greens).

Similarly, the second example shows a user selecting a lighter shade of green from the bottom of the display of the grassy hill. In this example, the user drags the eyedropper cursor over path 604 to achieve sampled color 614. The third example shows the user selecting a shade of green that in a middle area of the display of the grassy hill. As shown, the user blends a desired shade of green by scrubbing between the dark and light areas along path 606 to end up with a mix of dark, light, and other pixels in between, as shown in sampled color 616.

Figure 7:
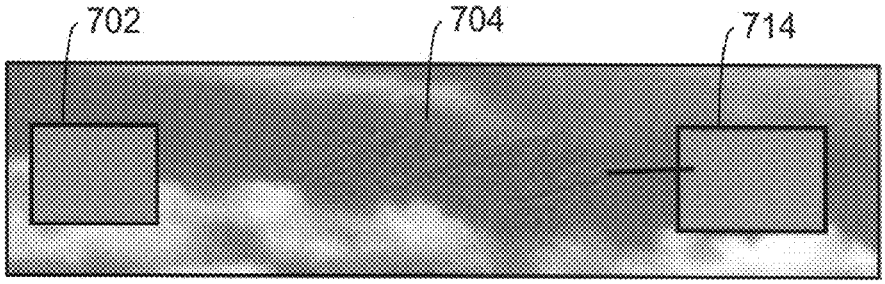
FIG. 7 illustrates another example of a color selection being made using a blended color sampling tool, according to one embodiment of the invention.

FIG. 7 illustrates another example of a color selection being made using a blended color sampling tool, according to one embodiment of the invention. In this example, a user is working with an image of clouds and sky. Additionally, the user has set a current color to a generally orange shade. For example, the user may have selected the orange color using a point sampling technique described above, or the user may have selected an orange color 702, which can be hexadecimal value FF7F00. Assume that the user has decided that the orange color 702 is too "bright" for the drawing. In such a case, the user may blend "softer" colors into the orange color 702 using the blended color sampling tool and eyedropper cursor. Rather than adjusting the RGBA values of the orange color 702, the user may mute the brightness of orange color 702 by scrubbing some lighter sky color along path 704 into the standard orange color 702. Illustratively, this results in blended color 714. As shown, blended color 714 is a muted orange that may suit the preferences of the user. This example illustrates how embodiments of the invention may be used to allow a user to blend new colors that work well with the general color palette of a pre-existing image.

As described, embodiments of the invention provide a more sophisticated color sampling tool. In particular, embodiments of the invention provide a color sampling tool where the user can blend selected colors into a current color. In one embodiment, the user may interact with a color sampling tool to select colors from a screen display. For example, the color sampling tool may display a filled eyedropper cursor that the user controls using a mouse device. The eyedropper cursor may be used to select colors form the screen display. In response, the color sampling tool blends selected colors into the current color at a constant rate. That is, rather than independently choosing colors one-by-one (point sampling), the user first selects a current color directly underneath the eyedropper cursor, and then subsequent colors picked using the eyedropper tool are incrementally blended into the current color using a constant blending factor. Alternatively, the current color may be selected based on a current color set for the application. In such a case, the newly selected color values are blended into this color at a constant rate. As the user clicks (or clicks-and-drags) the cursor on the screen, the color underneath the eyedropper cursor may be periodically and blended into the current color. This approach allows the user to gradually blend colors from the screen display, much as a painter would gradually mix colors on a palette.

While the forgoing is directed to embodiments of the present invention, other and further embodiments of the invention may be devised without departing from the basic scope thereof. For example, aspects of the present invention may be implemented in hardware or software or in a combination of hardware and software. One embodiment of the invention may be implemented as a program product for use with a computer system. The program(s) of the program product define functions of the embodiments (including the methods described herein) and can be contained on a variety of computer-readable storage media. Illustrative computer-readable storage media include, but are not limited to: (i) non-writable storage media (e.g., read-only memory devices within a computer such as CD-ROM disks readable by a CD-ROM drive, flash memory, ROM chips or any type of solid-state non-volatile semiconductor memory) on which information is permanently stored; and (ii) writable storage media (e.g., floppy disks within a diskette drive or hard-disk drive or any type of solid-state random-access semiconductor memory) on which alterable information is stored. Such computer-readable storage media, when carrying computer-readable instructions that direct the functions of the present invention, are embodiments of the present invention. Therefore, the scope of the present invention is determined by the claims that follow.

What is claimed is:

1. A method of selecting a color, comprising:

receiving a selection of a screen pixel on a screen display of a computer system that includes a mouse, wherein the selection is a result of a user clicking a button on the mouse and dragging a mouse cursor across the screen display while holding down the mouse button;

determining a first color value corresponding to a color of the screen pixel;

determining a second color value corresponding to an active color setting;

blending the first color value with the second color value to generate a third color value, wherein the first color value and the second color value are blended based on a constant blending factor; and storing the third color value as the active color setting, wherein the first color value and the second color value are blended based on the constant blending factor using a blending equation:

$$CSC = (AC)\left(\frac{1}{R}\right) + (OSC)\left(\frac{R-1}{R}\right)$$

wherein OSC represents the first color value, wherein AC represents the second color value, wherein R is greater than or equal to one and represents the constant blending factor, and wherein CSC represents the third color value.

2. The method of claim 1, wherein the active color setting is received in response to a user clicking on a pixel of the screen display with a mouse cursor.

3. The method of claim 1, further comprising:

receiving a selection of one or more additional color values, wherein each color value corresponds to a color of a screen pixel on the screen display; and successively blending each of the one or more additional color values with a color value of the active color setting, wherein each of the one or more additional color values is successively blended with the color value of the active color setting based on the constant blending factor.

4. The method of claim 3, wherein at least one of the additional color values is received based on a periodic sampling of mouse events.

5. The method of claim 1, wherein the constant blending factor is in the range of about 100 to about 200.

6. A non-transitory computer-readable storage medium storing instructions that when executed by a processor cause the processor to select a color by performing the steps of:

receiving a selection of a screen pixel on a screen display of a computer system that includes a mouse, wherein the selection is a result of a user clicking a button on the mouse and dragging a mouse cursor across the screen display while holding down the mouse button;

determining a first color value corresponding to a color of the screen pixel;

determining a second color value corresponding to an active color setting;

blending the first color value with the second color value to generate a third color value, wherein the first color value and the second color value are blended based on a constant blending factor; and storing the third color value as the active color setting, wherein the first color value and the second color value are blended based on the constant blending factor using a blending equation:

$$CSC = (AC)\left(\frac{1}{R}\right) + (OSC)\left(\frac{R-1}{R}\right)$$

wherein OSC represents the first color value,
wherein AC represents the second color value,
wherein R is greater than or equal to one and represents the constant blending factor, and
wherein CSC represents the third color value.

7. The computer-readable storage medium of claim 6, wherein the active color setting is received in response to a user clicking on a pixel of the screen display with a mouse cursor.

8. The computer-readable storage medium of claim 6, wherein the steps further comprise:

receiving a selection of one or more additional color values, wherein each color value corresponds to a color of a screen pixel on the screen display; and successively blending each of the one or more additional color values with a color value of the active color setting, wherein each of the one or more additional color values is successively blended with the color value of the active color setting based on the constant blending factor.

9. The computer-readable storage medium of claim 8, wherein at least one of the additional color values is received based on a periodic sampling of mouse events.

10. The computer-readable storage medium of claim 6, wherein the constant blending factor is in the range of about 100 to about 200.

11. A method for blending colors from colors of one or more pixels, comprising:

invoking a color selection tool provided by a computer aided design (CAD) application, wherein the color selection tool is configured to:

receive a selection of a screen pixel on a screen display of a computer system that includes a mouse, wherein the selection is a result of a user clicking a button on the mouse and dragging a mouse cursor across the screen display while holding down the mouse button;

determine a first color value corresponding to a color of the screen pixel;

determine a second color value corresponding to an active color setting;

blend the first color value with the second color value to generate a third color value, wherein the first color value and the second color value are blended based on a constant blending factor; and store the third color as the active color setting, wherein the first color value and the second color value are blended based on the constant blending factor using a blending equation:

$$CSC = (AC)\left(\frac{1}{R}\right) + (OSC)\left(\frac{R-1}{R}\right)$$

wherein OSC represents the first color value,
wherein AC represents the second color value,
wherein R is greater than or equal to one and represents the constant blending factor, and
wherein CSC represents the third color value.

12. The method of claim 11, wherein active color setting is selected by clicking on a pixel of the screen display with a mouse.

13. The method of claim 11, wherein the color selection tool is further configured to:

receive a selection of one or more additional color values, wherein each color value corresponds to a color of a screen pixel on the screen display; and successively blend each of the one or more additional color values with a color value of the active color setting, wherein each of the one or more additional color values is successively blended with the color value of the active color setting based on the constant blending factor.

14. The method of claim 13, wherein at least one of the additional color values is received based on a periodic sampling of mouse events.

15. The method of claim 11, wherein the constant blending factor is in the range of about 100 to about 200.

* * * * *